US009601863B2

(12) United States Patent
Takemura

(10) Patent No.: US 9,601,863 B2
(45) Date of Patent: Mar. 21, 2017

(54) DEVICE CONNECTOR WITH REINFORCING RIBS

(71) Applicant: Sumitomo Wiring Systems, Ltd., Yokkaichi (JP)

(72) Inventor: Akihiko Takemura, Yokkaichi (JP)

(73) Assignee: SUMITOMO WIRING SYSTEMS, LTD., Yokkaichi-Mie (JP)

( * ) Notice: Subject to any disclaimer, the term of this patent is extended or adjusted under 35 U.S.C. 154(b) by 6 days.

(21) Appl. No.: 14/483,586

(22) Filed: Sep. 11, 2014

(65) Prior Publication Data

US 2015/0079839 A1 Mar. 19, 2015

(30) Foreign Application Priority Data

Sep. 18, 2013 (JP) ..... 2013-192704

(51) Int. Cl.
*H01R 13/74* (2006.01)
*H01R 13/52* (2006.01)
*H01R 4/64* (2006.01)

(52) U.S. Cl.
CPC ..... *H01R 13/5202* (2013.01); *H01R 13/74* (2013.01); *H01R 4/64* (2013.01); *H01R 13/746* (2013.01); *H01R 2201/26* (2013.01)

(58) Field of Classification Search
CPC .. H01R 13/74; H01R 13/746; H01R 13/5202; H01R 4/64; H01R 2201/26
USPC ..... 439/607.01, 559, 562–565
See application file for complete search history.

(56) References Cited

U.S. PATENT DOCUMENTS 5,007,862 A * 4/1991 Defibaugh ..... H01R 13/64 439/564
7,731,543 B2 * 6/2010 Aoki ..... H01R 13/648 439/686
8,251,756 B2 8/2012 Matuoka
8,992,249 B2 * 3/2015 Kobayashi ..... H01R 13/6591 439/362

* cited by examiner

*Primary Examiner* — Felix O Figueroa
*Assistant Examiner* — Paul Baillargeon
(74) *Attorney, Agent, or Firm* — Gerald E. Hespos; Michael J. Porco; Matthew T. Hespos

(57) ABSTRACT

A device connector includes a housing (20) with terminal supporting portions (30) projecting through a mounting hole (2) in a case (1) of a device. A flange (25) protrudes on the outer periphery of the housing (20) and faces a surface (2A) of the case (1) outward of the mounting hole (2). A surface packing (15) is mounted on the front surface of the flange (25) and is compressed between the front surface of the flange (25) and the case (1). A reinforcing portion (28) includes circumferentially spaced ribs (27) on the rear surface of the flange (25) and aligned in a front-back direction. A metal bracket (60) is fit externally fit on the housing (20). The bracket (60) presses the rear surface of the reinforcing portion (28) over the entire circumference and is bolt-fastened to an outer surface of the case (1).

8 Claims, 9 Drawing Sheets

DEVICE CONNECTOR WITH REINFORCING RIBS

BACKGROUND

1. Field of the Invention

The invention relates to a device connector with an improved water proof structure.

2. Description of the Related Art

U.S. Pat. No. 8,251,756 discloses a device connector to be mounted on a case of a device in a waterproof manner. The connector includes a housing and terminal fittings are mounted in the housing. A bracket is provided for mounting the connector on the case. The terminal fittings project from one surface of the housing and are supported on terminal blocks. The terminal blocks and parts of the terminal fittings supported thereon project through a mounting hole in the case when the housing is mounted to the case. A flange protrudes out from the housing and faces a surface of the case outward of the mounting hole when the terminal block and the terminal fittings project into the mounting hole. A surface packing is attached to the surface of the flange that faces the case.

The bracket of the above-described device connector is fit on the housing, and the flange is placed on the surface of the case outward of the mounting hole with the surface packing sandwiched between the flange and the case. The bracket is bolt-fastened while the terminal blocks are inserted into the mounting hole of the case so that the housing is mounted on the outer surface of the case together with the bracket. The terminal blocks project into the case and the surface packing is compressed and sandwiched resiliently between the flange and the part of the case outward of the mounting hole to provide sealing around the mounting hole.

The surface packing needs to be compressed more strongly to enhance a waterproof function around the mounting hole. However, stronger compression increases a resilient force, and the relatively thin flange receives the resilient force. The flange has low bending strength, and there is a possibility that the flange will deform to cause leakage. The flange could be thickened to increase the bending strength. However, sinks are apt to form in the thicker flange. Sinks formed on the surface that contacts the packing could result in leakage.

The invention was completed based on the above situation and aims to enhance a waterproof function for a mounting hole on a case of a device.

SUMMARY OF THE INVENTION

The invention is directed to a device connector that has a housing with a terminal support capable of projecting through a mounting hole in a case of a device. A flange protrudes on the outer periphery of the housing and faces a surface of the case outward of the mounting hole. A surface packing is mounted on the front surface of the flange and is compressed between the front surface of the flange and the surface of the case outward of the mounting hole. A reinforcement is formed by circumferentially spaced ribs on the rear surface of the flange. The ribs extend in a front-back direction. A metal bracket is fit externally on the housing and presses the rear surface of the reinforcement over the entire circumference and is bolt-fastened to an outer surface of the case.

The device connector is mounted to the case with the front surface of the flange facing the surface of the case outward of the mounting hole and with the surface packing between the case and the front surface flange. The bracket then is bolt-fastened to the case of the device so that the housing is mounted on the outer surface of the case together with the bracket. At this time, the terminal supporting portion projects into the case and the surface packing is compressed and sandwiched resiliently between the flange and the surface of the case outward of the mounting hole, thereby sealing around the mounting hole.

A resilient force of the surface packing increases if the surface packing is compressed strongly. The flange receives that resilient force, but is strengthened by the reinforcement on the rear surface of the flange so that the bending strength of the flange is high. Further, the rear surface of the reinforcement is received by the metal bracket to prevent deformation of the flange due to the resilient force. The reinforcement includes circumferentially spaced ribs that extend in the front-back direction. Thus, a sufficient effective thickness of the flange in the front-back direction is achieved without increasing the thickness of the entire flange. As a result, sinks will not form on the front surface of the flange during molding, and sink-related leakage paths between the flange and the surface packing will not exist. Specifically, the surface packing can be pressed firmly over the entire circumference of the mounting hole and a waterproof function for the mounting hole can be enhanced reliably.

The bracket may have a stepped tubular shape with a small-diameter portion to be fit to the outer periphery of the housing and a large-diameter portion to be fit to an outer periphery from the flange to the reinforcement. A pressing portion is defined by a step between the large and small diameter portions and presses the rear surface of the reinforcement.

The bracket may be formed by aluminum die casting. Thus the bracket can be thick and rigidity can be enhanced, for example, as compared with the case where a bracket is formed by deep drawing a metal plate.

The bracket may double as a shield shell. Thus, a simple structure can be realized as compared with a design where the bracket and the shield shell are provided separately.

DETAILED DESCRIPTION

Figure 8:
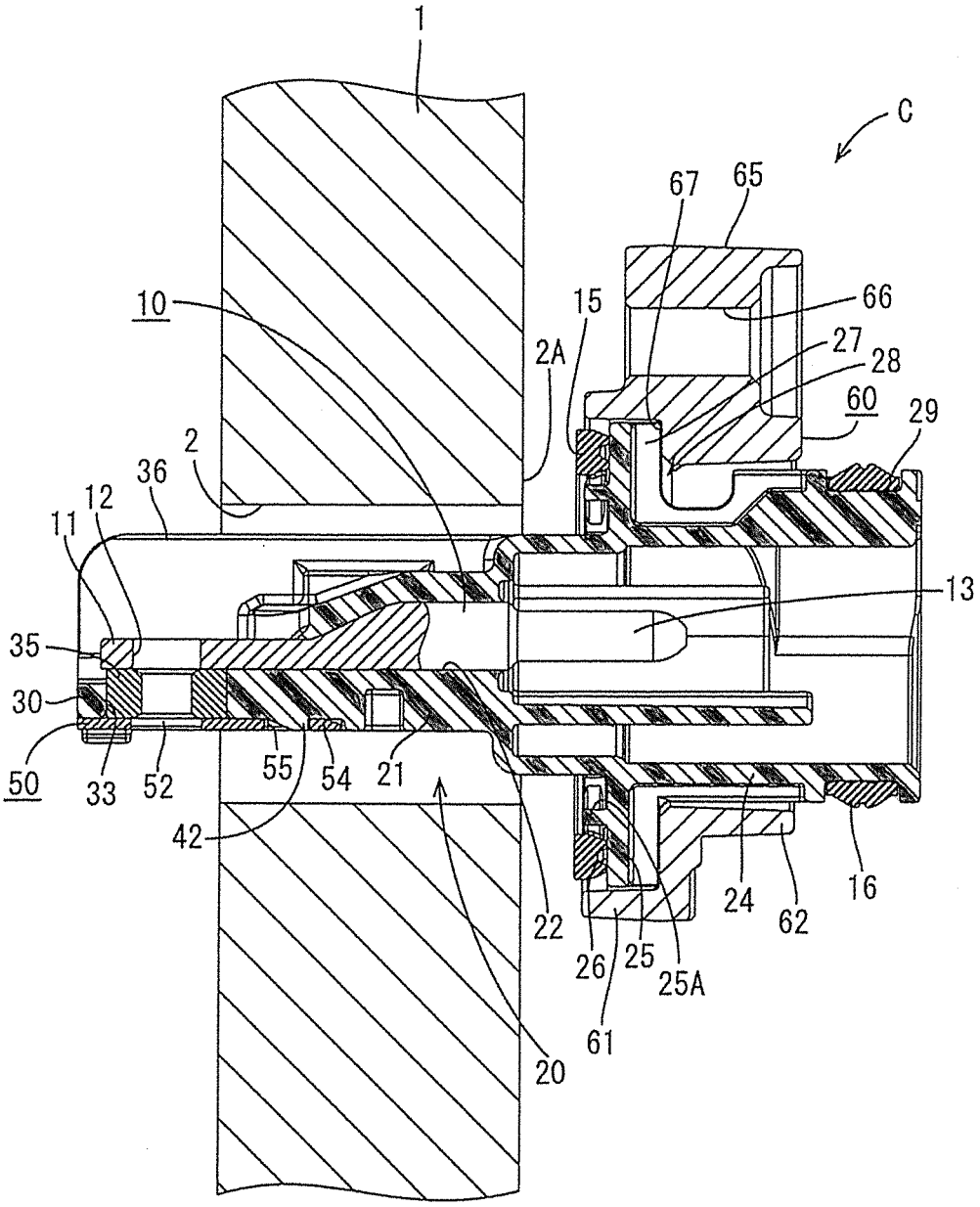
FIG. 8 is a section showing an operation of mounting the connector to a case.

A device connector C of this embodiment is applied to supply power to a device, such as a motor or an inverter in a hybrid vehicle, an electric vehicle or the like. As shown in FIG. 8, the device connector C is mounted to a metal case 1 of the device and an elliptical mounting hole 2 penetrates through the case 1.

Figure 9:
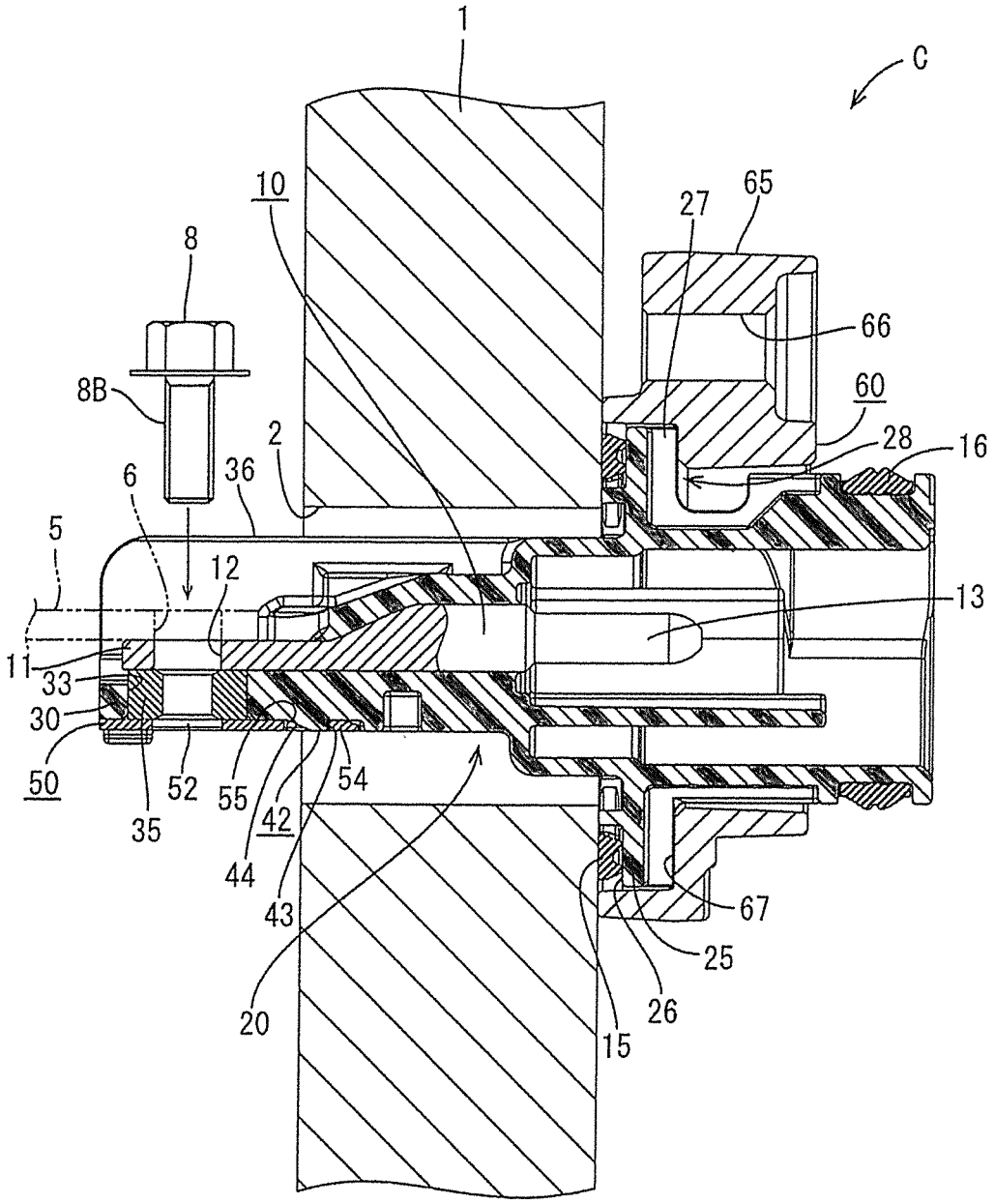
FIG. 9 is a section showing a state where the connector is mounted to the case.

The device connector C has a housing 20 made of synthetic resin and terminal fittings 10 are mounted in the housing 20. As shown in FIG. 9, the housing 20 is mounted on an outer surface of the case 1 via a bracket 60. Associated with that, tips of the terminal fittings 10 project into the case 1 through the mounting hole 2 while being supported on terminal blocks 30 projecting on the front surface of the housing 20. Mating terminals 5 in the case 1 are joined to the tips of the respective terminal fittings 10 by tightening bolts 8 and a wire-side connector (not shown) provided on an end of a harness is fit and connected to the rear surface of the housing 20.

In the following description of the device connector C, a vertical direction is based on FIG. 1. Thus a vertically inverted state is shown in FIGS. 8 and 9.

The device connector C includes the housing 20, the terminal fittings 10, a metal bracket 60 for mounting the housing 20 to the case 1, nuts 35 arranged in the terminal blocks 30 and the detachment preventing plate 50 for preventing the detachment of the nuts 35.

As shown in FIG. 8, a rear side of the terminal fitting 10 is a round pin terminal 13 and a tip side (left side of FIG. 8) is squeezed to form a connecting portion 11 in the form of a flat plate. A bolt insertion hole 12 is open on the connecting portion 11. The three terminal fittings 10 are juxtaposed at regular intervals and integrally incorporated into the housing 20 by insert molding.

As shown in FIGS. 1, 2, 4 and 8, the housing 20 has a main body 21 with an elliptical cross-section, and terminal insertion holes 22 are formed side by side at regular intervals in the main body 21 for receiving lengthwise central parts of the respective terminal fittings 10.

A rearwardly open elliptical fitting tube 24 is open on the rear surface of the main body 21 and the wire-side connector is fittable therein. A specified length of a front part of the fitting tube 24 can fit into the mounting hole 2 of the case 1 with a predetermined clearance.

The terminal blocks 30 project forward from upper edge parts of the respective terminal insertion holes 22 on the front of the main body 21. Lower parts of the respective terminal blocks 30 are joined by a coupling plate 31.

As shown in FIG. 8, the three terminal fittings 10 are embedded in the housing 20 so that lengthwise central parts thereof are inserted in the terminal insertion holes 22, round pins 13 on rear ends project into the fitting tube 24 and the connecting portions 11 on front ends extend along the lower surfaces of the terminal blocks 30.

Figure 4:
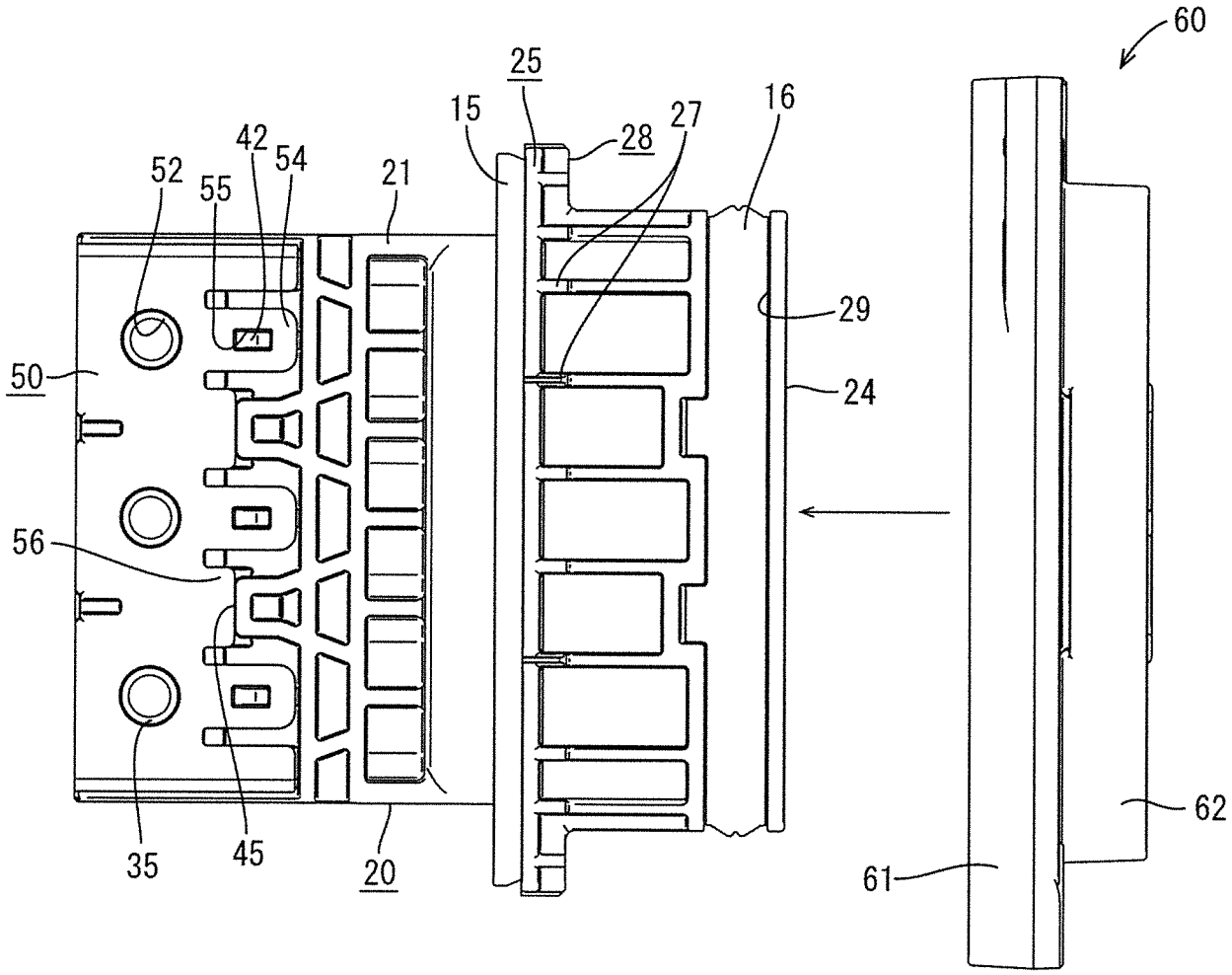
FIG. 4 is a plan view showing an attaching operation of a bracket.

A flange 25 is formed over the entire periphery of the fitting tube 24 of the housing 20 near the main body 21, as shown in FIGS. 4 and 8. A forwardly projecting receiving portion 25A is formed over the entire periphery on a base part of the front surface of the flange 25, and an attaching portion 26 for an elliptical annular surface packing 15 is formed at an outer periphery of the receiving portion 25A. The surface packing 15 can contact an edge 2A on an outer surface side of the mounting hole 2 of the case 1.

Circumferentially spaced ribs 27 are formed on a rib arranging portion 28 on the rear surface of the flange 25 and have heights slightly larger than the thickness of the flange 25.

A ring mounting groove 29 is formed around the entire outer periphery of a rear end part of the fitting tube 24 and a seal ring 16 is mounted into the ring mounting groove 29. The seal ring 16 seals between the device connector C and a shield shell on the wire-side connector.

A nut accommodating hole 33 having a square front view is formed on each terminal block 30 coaxially with the bolt insertion hole 12 of the connecting portion 11 of the terminal fitting 10. The nut 35 can be accommodated with a small clearance in the nut accommodating hole 33. Partition walls 36 stand on the coupling plate 31 formed over the respective terminal blocks 30 and partition between adjacent terminal blocks 30 and adjacent terminal fittings 10.

Figure 1:
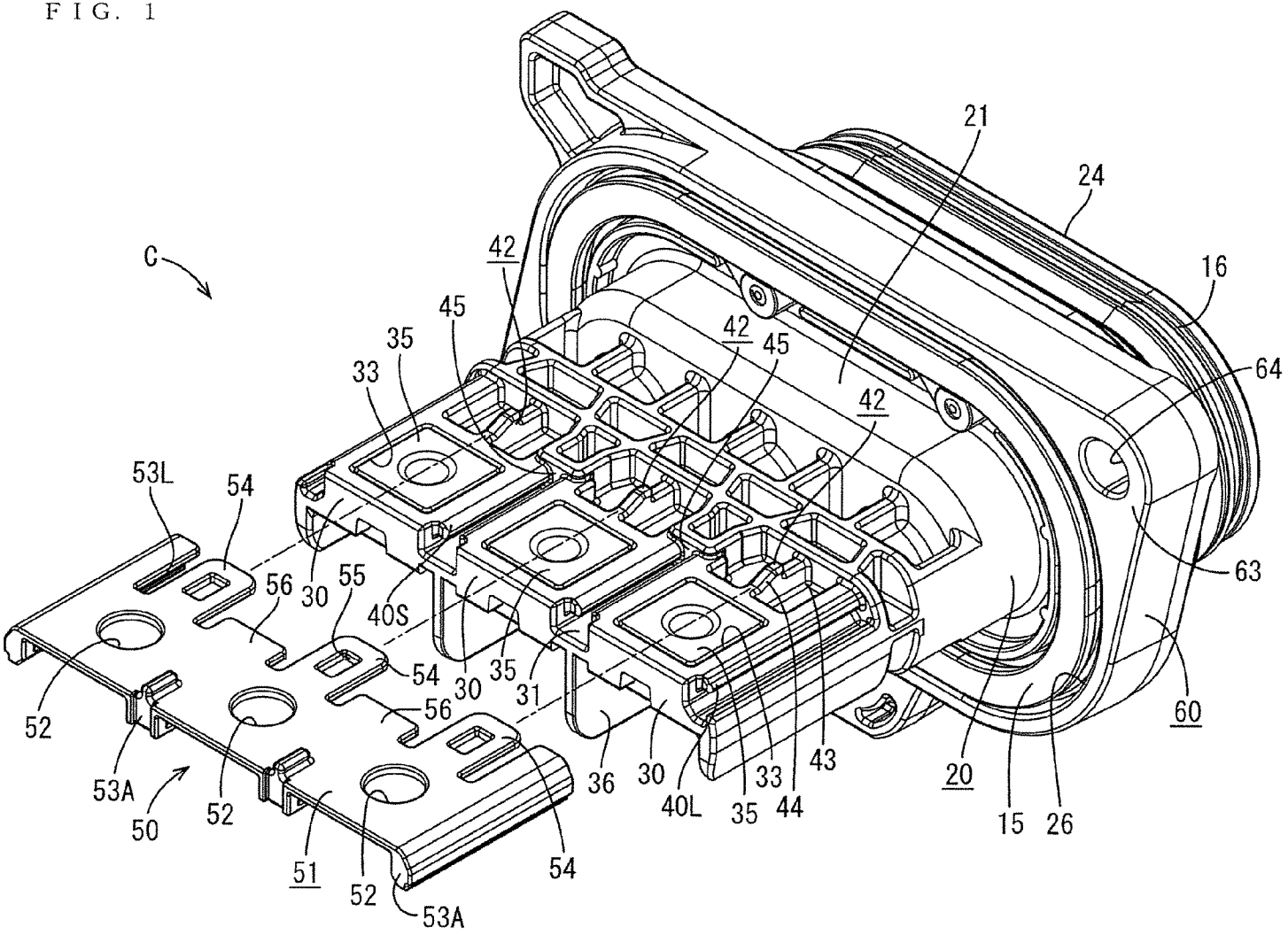
FIG. 1 is an exploded perspective view showing an attachment structure of a detachment preventing plate according to a connector of one embodiment of the invention.

As shown in FIG. 1, the detachment preventing plate 50 is attached on the upper surface sides of the terminal blocks 30 and collectively prevents detachment of all nuts 35 accommodated in the respective nut accommodating holes 33.

The detachment preventing plate 50 is made of synthetic resin and includes a wide main body plate 51 that can cover the nut accommodating holes 33 of all terminal blocks 30. Three side by side circular escaping holes 52 are formed in the main body plate 51 and are at the same intervals as the nut accommodating holes 33. Each escaping hole 52 allows the tip of a shaft 8B of the bolt 8 threadedly engaged with the nut 35 to escape.

Figure 2:
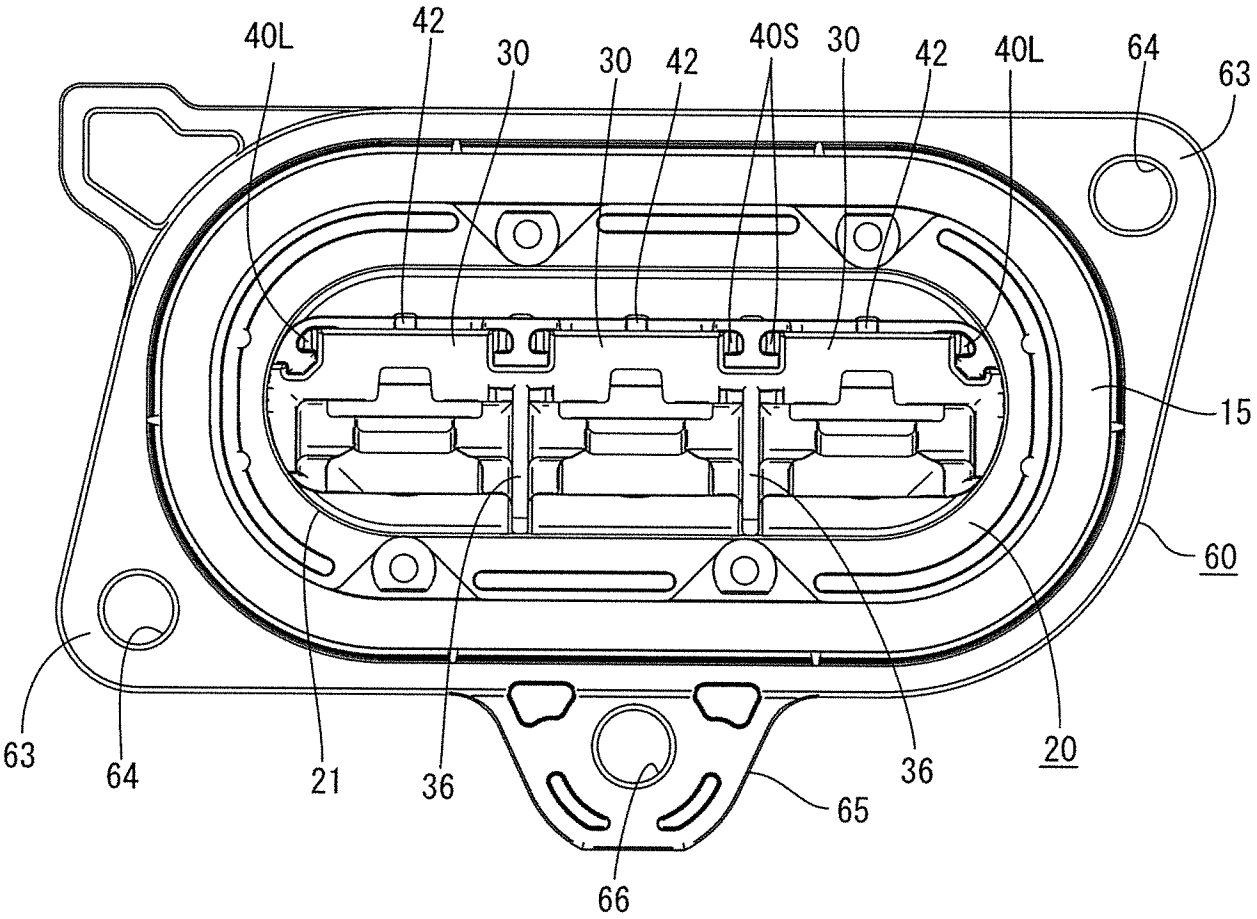
FIG. 2 is a front view of the connector in a state where the detachment preventing plate is detached.

Elongated fixed rails 40S, 40L protrude on opposite left and right sides of an upper surface of each terminal block 30, as shown in FIG. 2. As shown in FIG. 1, the four fixed rails 40S are in the center and extend from positions slightly retracted from the front edges of the terminal blocks 30 to positions slightly beyond the nut accommodating holes 33. On the other hand, the two fixed rails 40L are on opposite ends and extend from the positions slightly retracted from the front edges of the terminal blocks 30 to the front surface of the main body 21.

Figure 3:
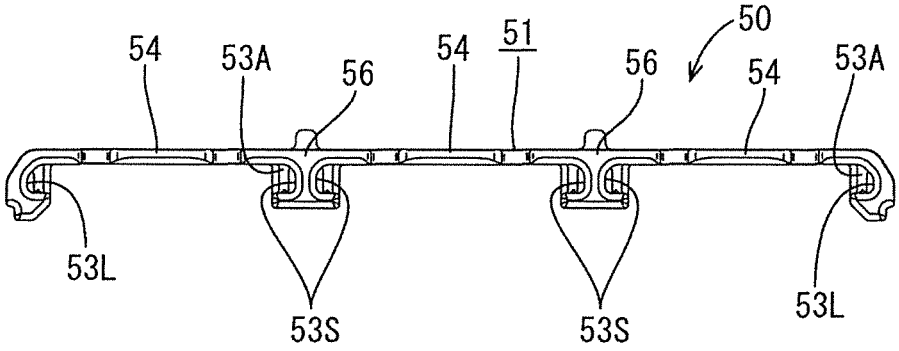
FIG. 3 is a front view of the detachment preventing plate.

On the other hand, two moving rails 53S, 53L are formed at opposite left and right sides of each escaping hole 52 on the lower surface of the detachment preventing plate 50, as shown in FIG. 3. The moving rails 53S, 53L are grooves and have open surfaces facing the corresponding fixed rails 40 so as to fit slidably fitted to the corresponding fixed rails 40.

The four moving rails 53S in the center are short in conformity with the corresponding fixed rails 40S, whereas two moving rails 53L on opposite ends are long and extend forward in an attaching direction in conformity with the corresponding fixed rails 40L. Closing plates 53A are formed on rear ends of all the moving rails 53 in the attaching direction.

Resiliently displaceable lock pieces 54 project from the front edge of the main body 51 of the detachment preventing plate 50 at positions aligned with the escaping holes 52. A lock hole 55 is formed in each lock piece 54. On the other hand, as shown in FIGS. 1 and 8, a lock protrusion 42 is formed on the upper surface of each terminal block 30 at a position behind and corresponding to the nut accommodating hole 33 and can fit into the lock hole 55 of the lock piece 54 for locking. The rear surface of the lock protrusion 42 is an upright locking surface 43 and the front surface is upwardly inclined guide surface 44.

As shown in FIG. 1, the detachment preventing plate 50 is pushed toward the main body 21 of the housing 20 along the upper surfaces of the terminal blocks 30 from a state where the tips of the moving rails 53L on the opposite ends are fit to the fixed rails 40L on the opposite ends and the tip of each lock piece 54 is placed on the front edge of the terminal block 30. The detachment preventing plate 50 is guided by the fixed rails 40 and pushed from halfway through while the short moving rails 53S in the center are fit to the fixed rails 40S. In a final stage, the detachment preventing plate 50 is pushed while the lock pieces 54 are resiliently deformed and move onto the lock protrusions 42. When the detachment preventing plate 50 is pushed to a position where the closing plates 53A of the moving rails 53 contact entrances of the fixed rails 40, the lock holes 55 reach the lock protrusions 42. Thus, the lock pieces 54 resiliently return and the lock protrusions 42 fit into the lock holes 55 to retain the detachment preventing plate 50.

The lock protrusions 42 are formed immediately before the front surface of the main body 21 of the housing 20. Thus, the detachment preventing plate 50 may be pushed further even after the lock pieces 54 are locked to the lock protrusions 42, for example, due to dimensional tolerances of the rails 40, 53 and the tips of the lock pieces 54 may butt against the front surface of the main body 21 to be plastically deformed.

Thus, butting plates 56 are provided at two positions between the lock pieces 54 on the front of the main body 51 of the detachment preventing plate 50, and stoppers 45 are formed at two positions between the lock protrusions 42 on the upper surfaces of the terminal blocks 30 against which the butting plates 56 butt to prevent the detachment preventing plate 50 from being pushed farther. The butting plates 56 are set to butt against the stoppers 45 before the tips of the lock pieces 54 butt against the main body 21 of the housing 20 after the lock pieces 54 are locked to the lock protrusions 42.

Figure 5:
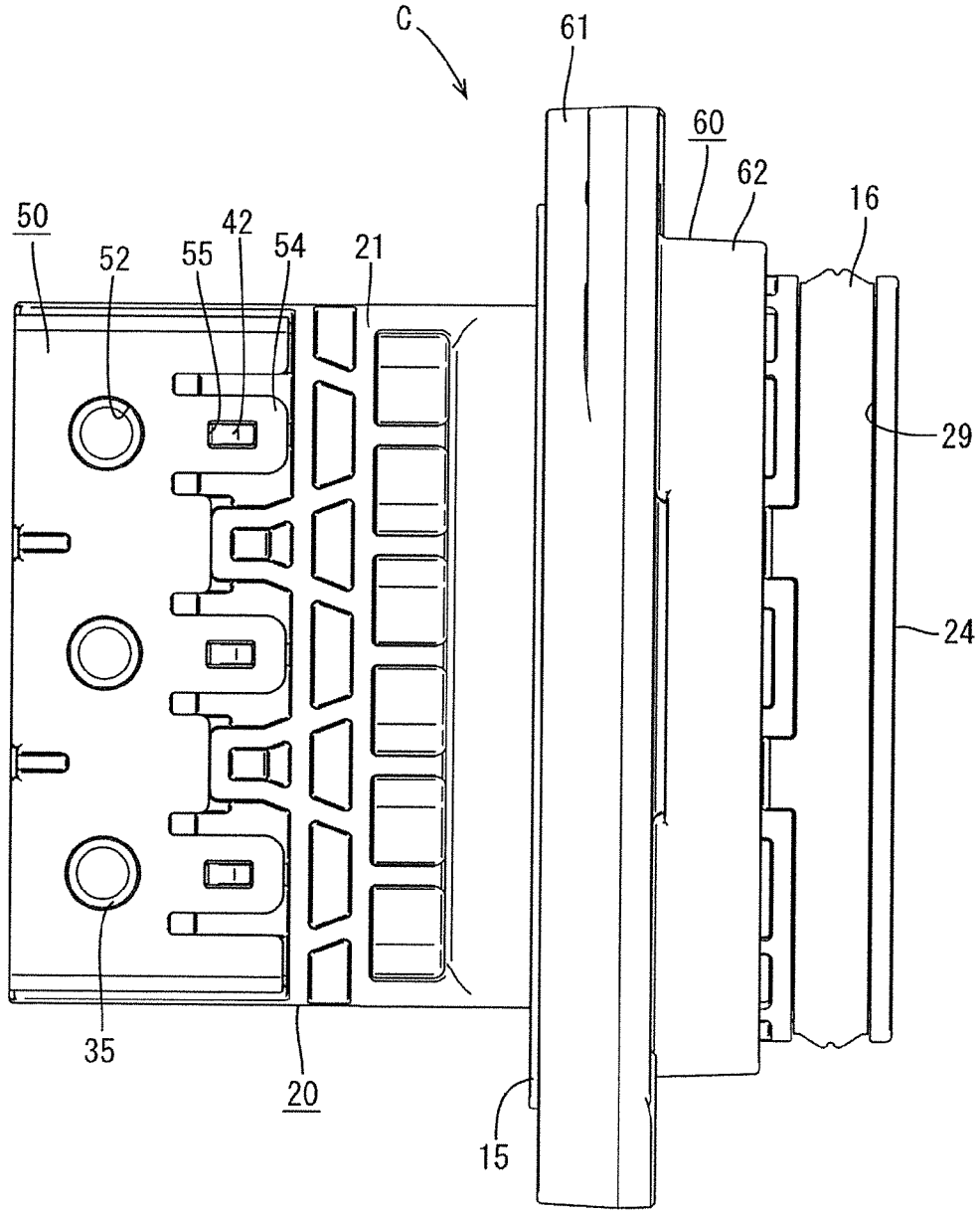
FIG. 5 is a plan view of the connector with the bracket attached.
Figure 6:
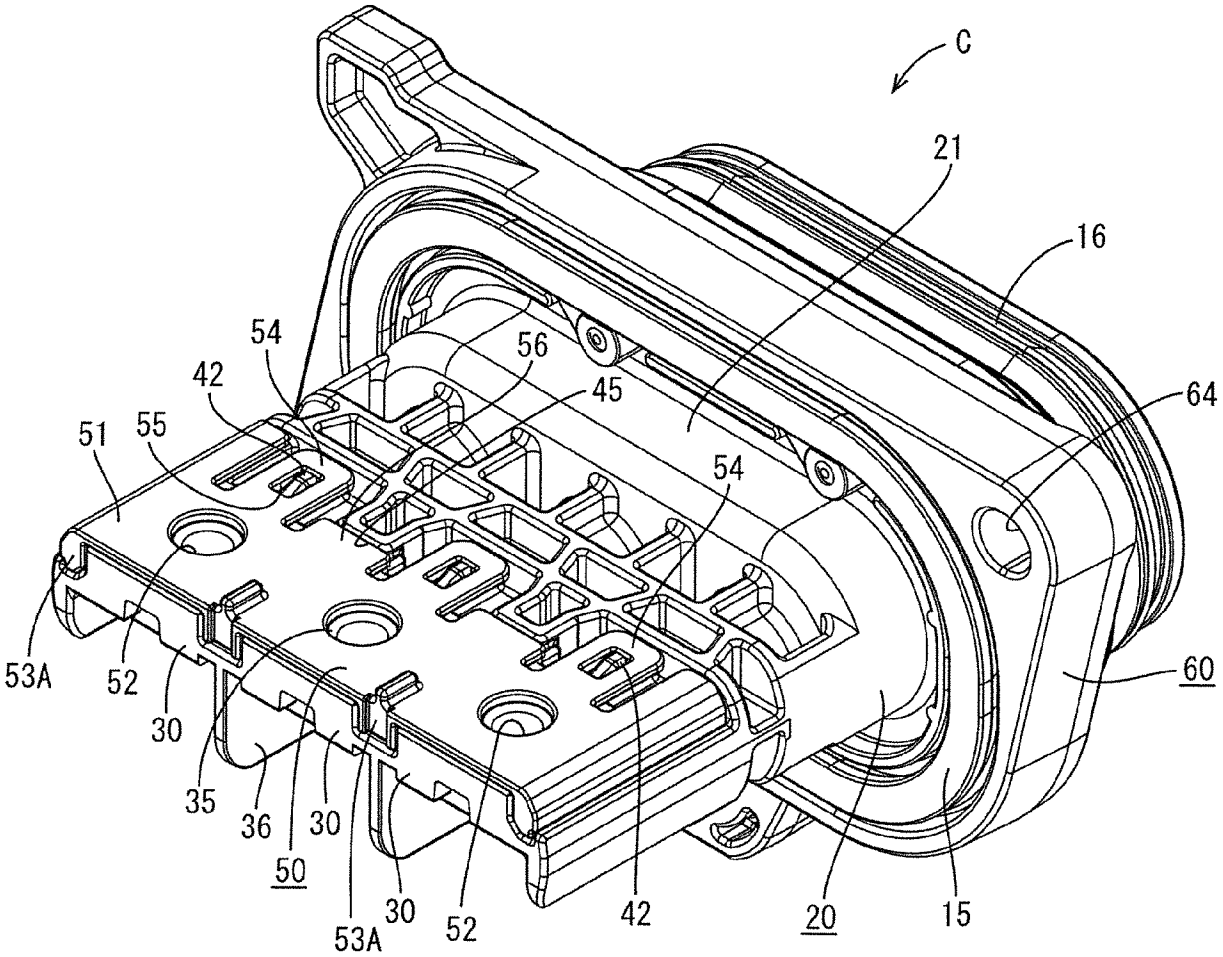
FIG. 6 is a perspective view showing an assembling completed state of the connector.
Figure 7:
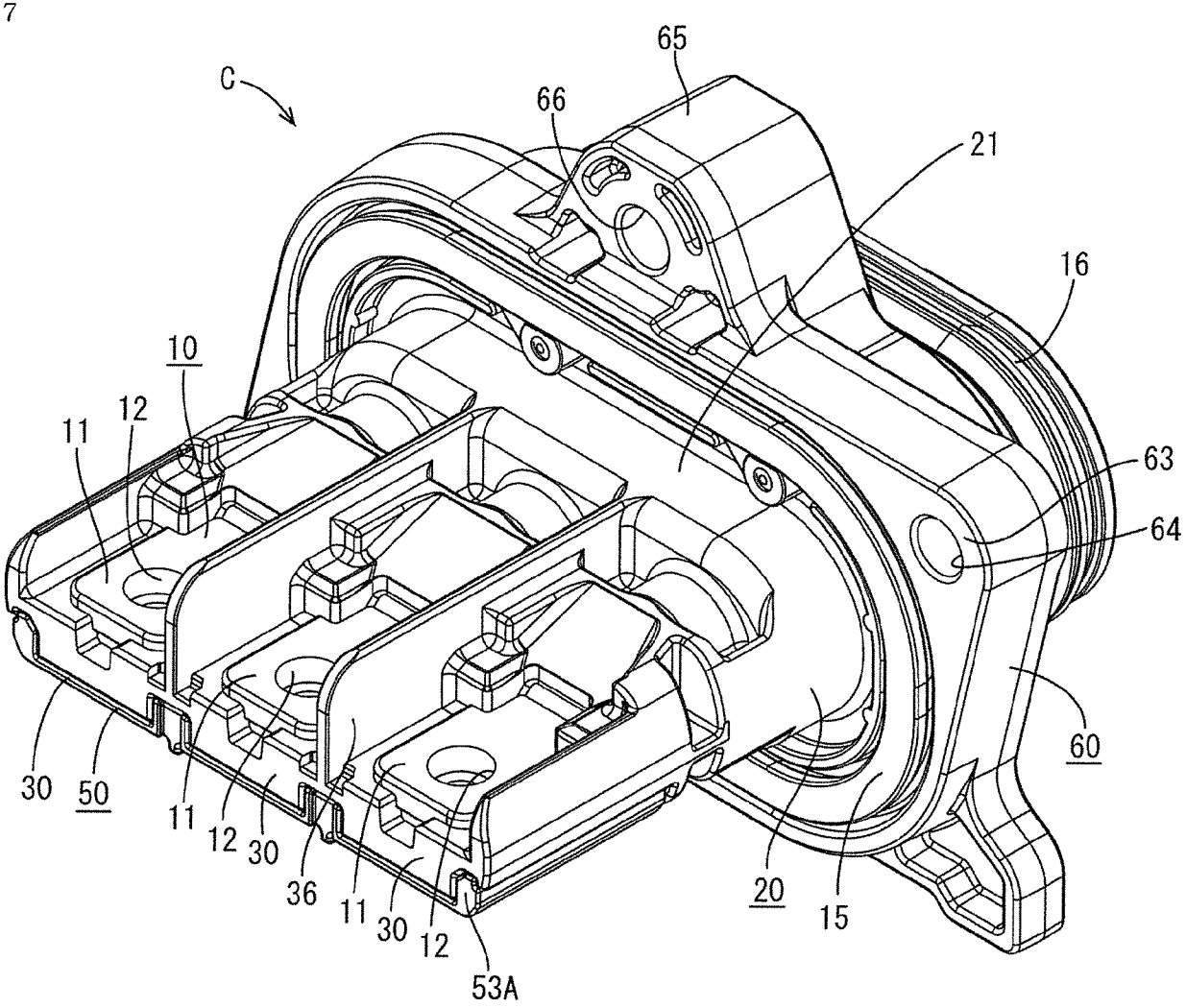
FIG. 7 is a perspective view of the connector in a vertically inverted state.

The bracket 60 is made of die cast aluminum and, as shown in FIGS. 5 and 8, defines a stepped elliptical tubular shape to cover the outer peripheral surface of an area of the housing 20 from the flange 25 to a position before the ring mounting groove 29. More specifically, the bracket 60 has a small diameter portion 62 to be fit tightly to the outer periphery of an area before the ring mounting groove 29 and a large diameter portion 61 to be fit tightly to the outer periphery of the flange 25, including the packing attaching portion 26 on the front surface and the reinforcing portion 28. An elliptical annular step surface 67 is formed on the inner periphery of the bracket 60, and the step surface 67 functions as a pressing surface for pressing the rear surface of the reinforcing portion 28 formed on the rear surface of the flange 25.

As shown in FIG. 2, mounting portions 63 protrude on upper-right and lower-left corner parts of the large diameter portion 61 of the bracket 60 in a front view, and each mounting portion 63 has an insertion hole 64 for a bolt (not shown) to attach the bracket 60 to the outer surface of the case 1.

A connecting portion 65 protrudes at a center of the lower edge of the bracket 60 and has a thickness from a position slightly retracted from the front surface of the large diameter portion 61 to the rear surface of the small diameter portion 62. This connecting portion 65 has a screw hole 66 that can threadedly engage a bolt (not shown) to fasten the connecting portion 65 to the shield shell (not shown) mounted on the wire-side connector.

To assemble the connector C, the housing 20 with the three terminal fittings 10 integrally incorporated therein is formed by insert molding. The nuts 35 then are accommodated in the nut accommodating holes 33 of the respective terminal blocks 30 in a rotation prevented manner, as shown in FIG. 1.

The detachment preventing plate 50 then is pushed along the upper surfaces of the terminal blocks 30 while the moving rails 53 slide along the fixed rails 40. The detachment preventing plate 50 is pushed to a predetermined position so that the lock holes 55 of the lock pieces 54 fit to the lock protrusions 42 to retain the detachment preventing plate 50. Thus, the main body 51 of the detachment preventing plate 50 covers all of the nut accommodating holes 33 and the escaping holes 52 are concentric with the respective nut accommodating holes 33.

The surface packing 15 is attached to the packing attaching portion 26 on the front of the flange 25 of the housing 20 and the seal ring 16 is mounted into the ring mounting groove 29 on the rear of the housing 20.

The bracket 60 then is fit externally from the rear until a step 67 on the inner periphery of the bracket 60 contacts the ribs 27 of the reinforcing portion 28 on the rear surface of the flange 25, as shown in FIG. 9. Thus, the assembly of the connector C is completed and the front surface of the surface packing 15 on the packing attaching portion 26 projects by a predetermined amount from the front surface of the large-diameter portion 61 of the bracket 60.

The assembled connector C is set in a vertically inverted posture, as shown in FIG. 8, and is inserted into the mounting hole 2 of the case 1 with the terminal blocks 30 in the lead. The connector C is inserted until the surface packing 15 contacts the edge 2A on the outside of the mounting hole 2. Bolts are inserted into the insertion holes 64 of the mounting portions 63 on the bracket 60, and threadedly engage screw holes at corresponding positions on the outer surface of the case 1 and tightened to fix the housing 20 via the bracket 60 while the surface packing 15 is compressed resiliently, as shown in FIG. 9. In this way, the terminal blocks 30 of the housing 20 project into the case 1 through the mounting hole 2 and the edge 2A of the mounting hole 2 of the case 1 is sealed by the surface packing 15.

After the connector C is mounted, the mating terminal 5 is placed on the connecting portion 11 of each terminal fitting 10 supported on the terminal block 30. The bolt 8 then is inserted into the bolt insertion holes 6, 12, engaged threadedly with the nut 35, and tightened by a tool such as a wrench, as shown in FIG. 9 in the case 1, to connect the terminals 5, 10 to each other.

On the other hand, the wire-side connector is fit in a sealed manner into the fitting tube 24 of the housing 20 and the shield shell of the wire-side connector is connected to the connecting portion 65 of the bracket 60 by bolt fastening. A rubber boot then is mounted on an end of the wire-side connector.

In mounting the device connector C to the case 1, the surface packing 15 attached to the front surface of the flange 25 of the housing 20 needs to be compressed strongly to provide reliable sealing around the mounting hole 2 of the case 1. A resilient force also increases as the surface packing 15 is compressed strongly, a resilient force also increases. The flange 25 that receives the resilient force is thickened by forming the reinforcing portion 28 on the rear surface and the flange 25 to achieve a sufficient thickness in the front-back direction. Thus, bending strength is high. Further, the rear surface of the reinforcing portion 28 is received by the aluminum die cast bracket 60. Thus, deformation of the flange 25 is prevented. Further, the reinforcing portion 28 provided to ensure a sufficient thickness of the flange 25 in the front-back direction is defined by circumferentially spaced ribs 27. Hence, molding will not generate sinks on the attaching surface 26 that receives the surface packing 15, thereby distinguishing from the case where the flange 25 is thickened uniformly over the entire circumference. Accordingly, the surface packing 15 can be pressed firmly over the entire circumference outward of the edge 2A of the mounting hole 2 and a waterproof function for the mounting hole 2 is enhanced reliably.

The bracket 60 is formed by aluminum die casting, and therefore can be thick and highly rigid, as compared with the case where a bracket is formed such as by deep drawing a metal plate.

The bracket 60 doubles as a shield shell. Thus, a simple structure is realized as compared with the case where a bracket and a shield shell are provided separately.

The invention is not limited to the above described embodiment. For example, the following embodiments also are in the scope of the invention.

The bracket may be formed not only by aluminum die casting, but also by press-forming a metal plate.

The number, thickness, height and the like of the ribs constituting the reinforcing portion on the rear surface of the flange can be arbitrarily selected according to desired strength.

The assembling procedure of the connector illustrated in the above embodiment is only an example and the connector may be assembled in another procedure.

Besides the mode illustrated in the above embodiment in which the terminal block provided with the nut is provided in the housing, the bolt fastening structure for the terminal fitting arranged in the device connector and the mating terminal arranged in the case may have another mode such as the one in which the nut is directly provided on the connecting portion of the terminal fitting and the one in which the terminal block is provided in the case.

Although the device connector of a type in which the separately provided wire-side connector is fitted and connected is illustrated in the above embodiment, the present invention is similarly applicable to a device connector of a type in which a terminal fitting connected to an end of a wire is directly mounted in a housing.

LIST OF REFERENCE SIGNS

C . . . device connector
1 . . . case
2 . . . mounting hole
2A . . . hole edge part
15 . . . surface packing
20 . . . housing
30 . . . terminal block (terminal supporting portion)
25 . . . flange
26 . . . packing attaching portion
27 . . . rib
28 . . . reinforcing portion
60 . . . bracket
61 . . . large-diameter portion
62 . . . small-diameter portion
63 . . . mounting portion
64 . . . insertion hole
67 . . . step

What is claimed is:

1. A device connector, comprising:

a housing with a terminal supporting portion configured for projecting through a mounting hole of a case of a device, the housing having opposite front and rear ends and an outer periphery extending between the ends;

a flange protruding from the outer periphery at a position spaced from the front and rear ends of the housing and having opposite front and rear surfaces, the front surface of the flange facing an outer surface of the case outward of the mounting hole;

a rear circumferential rib extending around the housing in proximity to the rear end and a front circumferential rib extending around the housing at a position between the rear circumferential rib and the flange, a ring mounting groove being defined between the front and rear circumferential ribs for receiving a seal ring;

a surface packing mounted on the front surface of the flange and compressed between the front surface of the flange and the case outward of the mounting hole;

a reinforcing portion having circumferentially spaced reinforcing ribs, each of the reinforcing ribs having a radial leg extending from the rear surface of the flange and an axial leg extending from the respective radial leg to the front circumferential rib, each of the radial legs of the reinforcing ribs having a rear surface spaced forward from the front circumferential rib of the housing and aligned normal to a front-back direction; and a metal bracket fit externally around the flange and around parts of the outer periphery of the housing rearward of and adjacent to the flange and pressing the rear surfaces of the ribs of the reinforcing portion over an entire circumference of the housing and bolt-fastened to an outer surface of the case.

2. The device connector of claim 1, wherein the bracket has a stepped tubular shape with a small-diameter portion fit to the outer periphery of the housing at positions outward of the axial legs of the reinforcing ribs, the small-diameter portion being connected to and behind a large-diameter portion fit to the outer periphery from the flange and outer peripheral ends of the radial legs of the reinforcing ribs and a step of the bracket defining a pressing portion for pressing the rear surfaces of the radial legs of the reinforcing ribs.

3. The device connector of claim 1, wherein the bracket is formed by aluminum die casting.

4. The device connector of claim 1, wherein the bracket shields the connector.

5. The device connector of claim 1, wherein each of the ribs extends from the outer periphery of the housing to an outer periphery of the flange.

6. The device connector of claim 5, wherein an extending dimension of each of the ribs from the outer periphery of the housing to an outer periphery of the flange exceeds a projecting distance of each of the ribs in the front-back direction from the rear surface of the flange.

7. The device connector of claim 5, wherein a projecting distance of each of the ribs from the rear surface of the flange is slightly greater than a thickness of the flange in the front back dimension.

8. The device connector of claim 2, wherein the small diameter portion of the bracket surrounds at least part of the outer periphery of the housing rearward of the flange and forward of the ring mounting groove.

* * * * *